United States Patent [19]

Barto et al.

[11] 3,969,909

[45] July 20, 1976

[54] REFRIGERATOR WATER RESERVOIR ASSEMBLY FOR THE AUTOMATIC ICE MAKER AND THE ICE WATER DISPENSER

[76] Inventors: Robert W. Barto, 2019 Duval Lane, Hayward, Calif. 94545; Leonard A. Brown, 13229 Casa Vista, Poway, Calif. 92064

[22] Filed: Jan. 13, 1975

[21] Appl. No.: 540,553

[52] U.S. Cl. ..... 62/179; 62/340; 222/56

[51] Int. Cl.[2] ..... F25C 1/04

[58] Field of Search ..... 62/179, 390, 348, 340, 62/353; 222/56

[56] References Cited

UNITED STATES PATENTS

| | | | |
|---|---|---|---|
| 2,846,854 | 8/1958 | Galin | 62/337 X |
| 3,429,140 | 2/1969 | White | 62/390 X |
| 3,583,437 | 6/1971 | Mastroianni | 222/56 X |
| 3,750,420 | 8/1973 | Webb | 62/353 X |
| 3,826,102 | 7/1974 | Horvay et al. | 62/188 X |

*Primary Examiner*—William E. Wayner
*Assistant Examiner*—William E. Tapolcai, Jr.
*Attorney, Agent, or Firm*—William R. Piper

[57] ABSTRACT

A refrigerator water reservoir that takes the place of connecting the refrigerator to the city water supply, the reservoir being connected to the automatic ice maker and to the ice maker dispenser for automatically delivering water to either unit as soon as the ice maker starts operating or when the ice water dispenser is actuated. No alterations are necessary to be made in a standard refrigerator that is already equipped with the automatic ice maker and with the ice water dispenser. The water reservoir assembly is equipped with a motor driven pump and with a water pressure sensitive switch so that the water in the conduit leading from the reservoir to the two solenoid valves, which in turn control the flow of water to the ice maker and to the ice water dispenser, will be maintained at a desired water pressure at all times. The device also has manually controlled means for refilling the reservoir when needed.

3 Claims, 7 Drawing Figures

REFRIGERATOR WATER RESERVOIR ASSEMBLY FOR THE AUTOMATIC ICE MAKER AND THE ICE WATER DISPENSER

SUMMARY OF THE INVENTION

An object of our invention is to save the installation charge made by a plumber who would normally have to connect the city water supply line to the part of the refrigerator that supplys water to the automatic ice maker and to the ice water dispenser. Also, another advantage is that with our refrigerator water reservoir assembly, when applied to the refrigerator, it does away with the necessity of placing the refrigerator near to a water pipe that carries city water at a predetermined water pressure. The refrigerator can be placed anywhere desired. No changes in the refrigerator need be made when applying our device to it.

A further object of our invention is to provide a device of the type described which is simple in construction and makes use of a single manually operated valve that can be swung into "REFILL" position for adding water to the reservoir and then can be swung into automatic or normal position where the device will automatically feed water at the proper pressure to either the ice maker or the ice water dispenser when it is needed.

BRIEF DESCRIPTION OF THE DRAWINGS

FIG. 1 illustrates the cover lifted and the section line 2—2 in this Figure indicates the portion of the reservoir and operative mechanism being shown in FIG. 2.

DESCRIPTION OF THE PREFERRED EMBODIMENT

Figure 1:
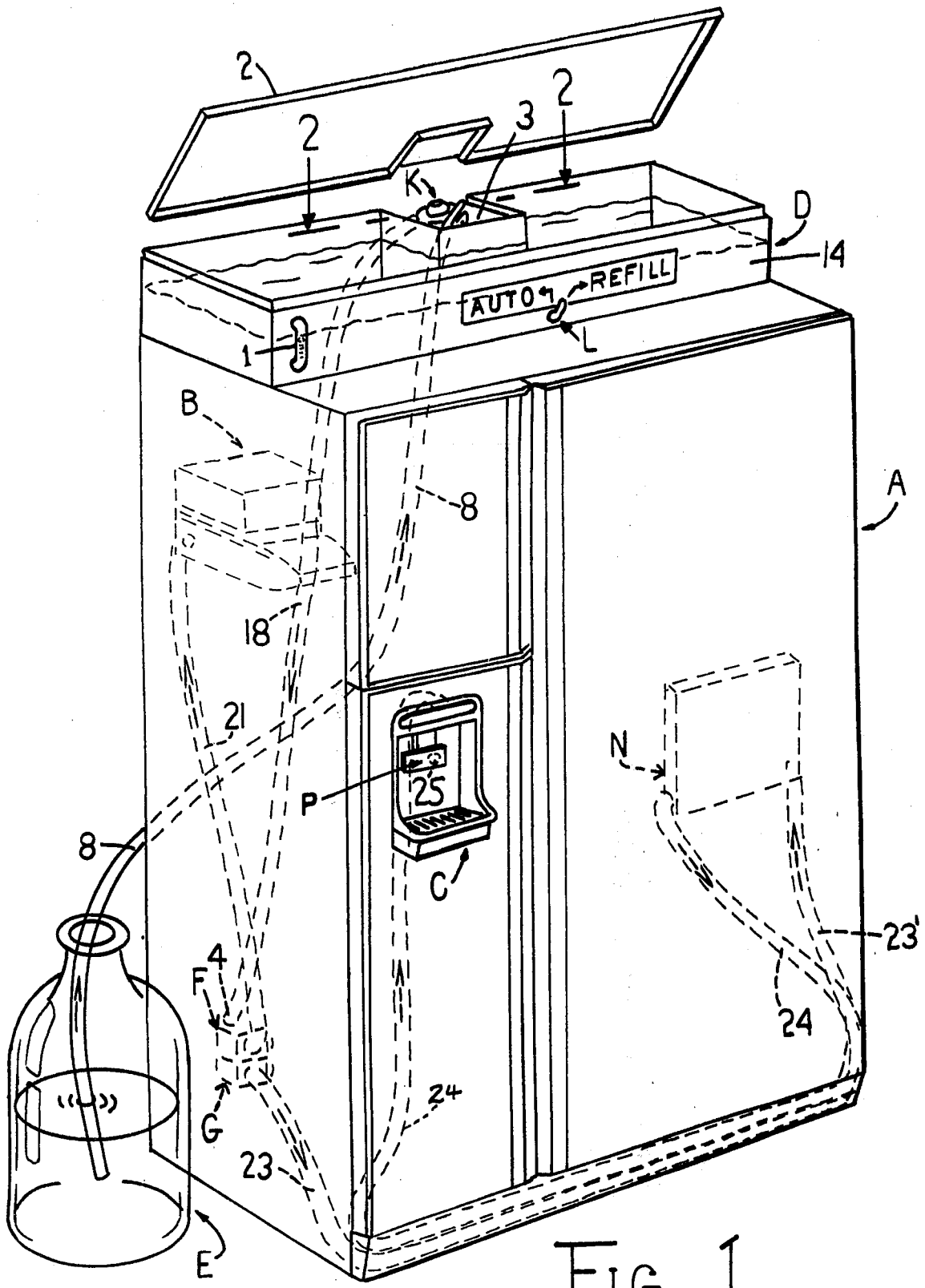
FIG. 1 is an isometric view of a standard refrigerator that has an automatic ice maker and an ice water dispenser. Our device is mounted on the top of the refrigerator and has a water conveying conduit extending from the reservoir to the standard water inlet to the two solenoid valves, one of the valves controlling the flow of water to the automatic ice maker and the other valve feeding water to the ice water dispenser when needed.

In carrying out our invention we make use of a standard refrigerator indicated generally at A in FIG. 1, and has a standard automatic ice maker, shown by dotted lines at B, and a standard ice water dispenser shown at C. Our device includes a reservoir D that is preferably placed on top of the refrigerator and is large enough in capacity to hold about six gallons of water. A water gage 1 is applied to the front wall of the reservoir and will indicate the level of water in the reservoir. If desired, the water gage may have its tube calibrated for indicating the actual volume of water in the reservoir. A cover 2 normally closes the top of the reservoir but we have shown the cover lifted above the top of the reservoir so that the compartment 3 disposed at the rear of the reservoir can be viewed.

Figure 3:
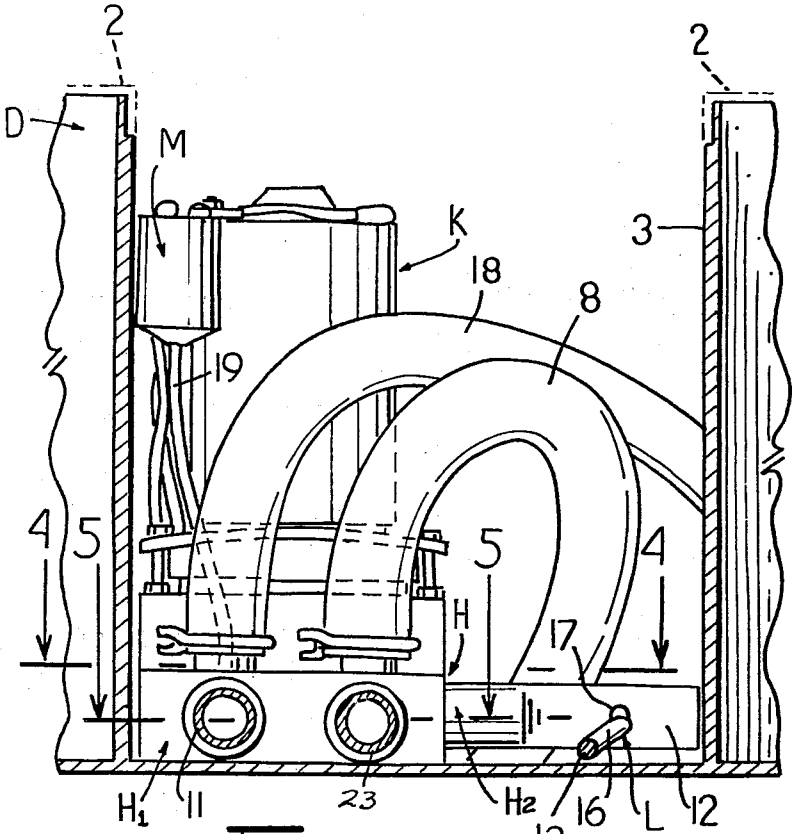
FIG. 3 is a vertical transverse section taken along the line 3—3 of FIG. 2 and shows the multiple valve housing and motor in elevation.
Figure 2:
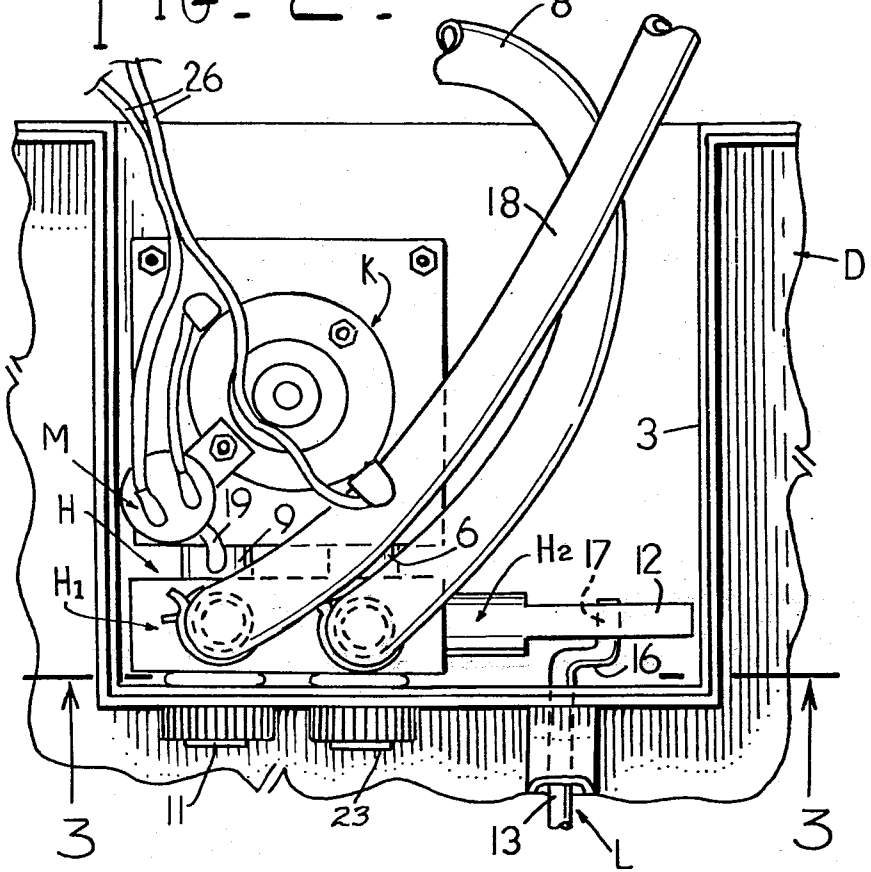
FIG. 2 is an enlarged top plan view of the motor and pump and shows the connections between the pump and the multiple valve. This Figure further shows the adjacent portion of the water reservoir with the cover for the reservoir removed.

We will first describe what is mounted in the compartment 3 and then will mention the water conveying conduits that lead from the multiple valve in the compartment to the auxiliary water supply E and to the water inlet 4 at the back of the refrigerator that connects with the two standard solenoid valves F and G already provided in the refrigerator, see FIG. 1. An enlarged top view of the compartment 3 at the rear of the reservoir D is shown in FIG. 2 and a front view of the compartment with the front wall removed is shown in FIG. 3. The multiple valve is indicated generally at H in both of these Figures and it consists of a housing H1 and a slidable valve body H2. Directly in back of the multiple valve H there is a water pump J, see FIG. 4, and mounted on top of the pump is an electric motor K, see FIGS. 2 and 3, that is operatively connected to the pump.

Figure 4:
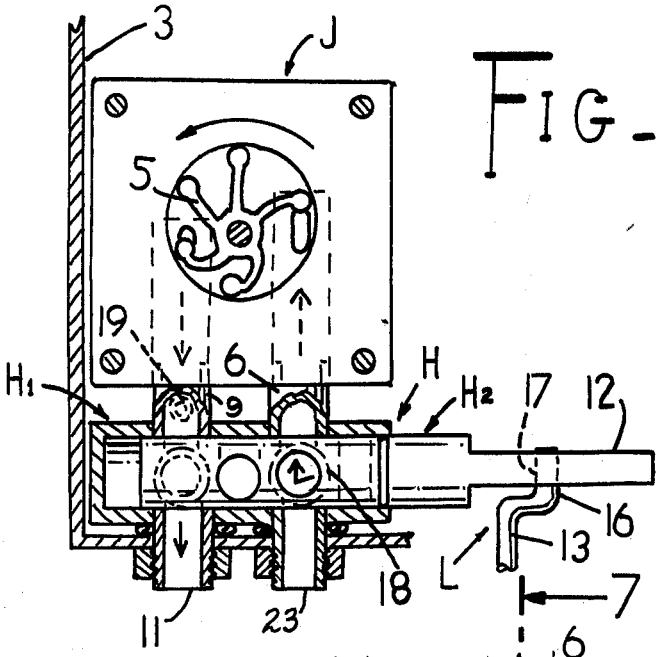
FIG. 4 is a horizontal section taken along the line 4—4 of FIG. 3 and shows the valve housing in section but the valve body is not shown in section.
Figure 5:
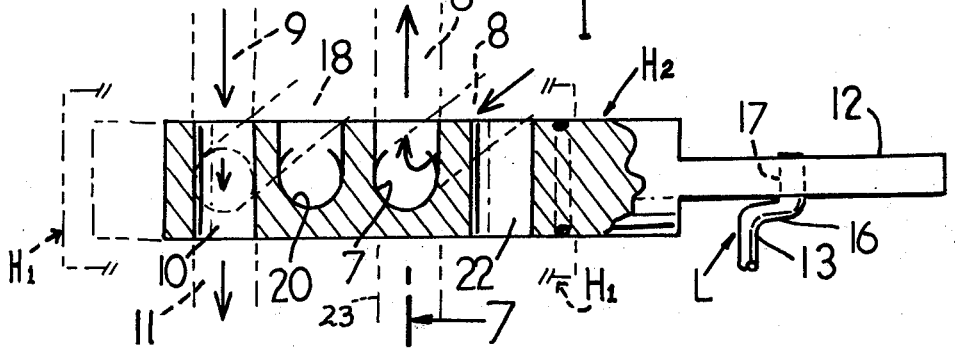
FIG. 5 is an enlarged horizontal section through the valve body and is taken along the section line 5—5 of FIG. 3. The valve body has been moved into REFILL position for replenishing the reservoir with water.
Figure 7:
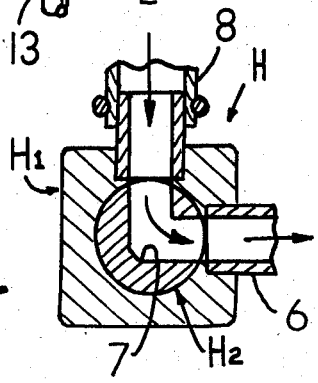
FIG. 7 is a vertical transverse section through the valve body and is taken along the line 7—7 of FIG. 5.

In FIG. 4 the housing H1 of the multiple valve H is shown in horizontal section while the valve body H2 is shown in elevation. The pump J has a rotor 5 that rotates in a counter clockwise direction. An inlet pipe 6 for the pump J communicates with the valve housing H1 and with an L-shaped passage 7 in the valve body H2 when the valve body is in REFILL position. Both FIGS. 4 and 5 illustrate the valve body H2 in REFILL position which means that water will be withdrawn from the auxiliary source of water as shown by the five gallon jug of water E and delivered to the reservoir D for replenishing it. The transverse sectional view in FIG. 7 illustrates the L-shaped passage 7 in the valve body H2 in communication with the pump inlet pipe 6 and with a conduit 8 that leads to the auxiliary water source E, see also FIGS. 1, 2 and 3. The pump J draws water from the auxiliary source E through the conduit 8, the passage 7 in the valve body H2, the pipe 6 to the pump. From here the water is forced through the pump outlet pipe 9 to the valve housing H1 where the pipe communicates with a horizontal passage 10 in the valve body H2 when the valve body is in REFILL position, see FIG. 5. The water flows through the valve body passage 10 and then through a stub pipe 11 that extends from the valve housing H1 and into the reservoir D.

A separate switch, not shown, may be used for connecting the motor K to a source of current when the valve body H2 is in REFILL position. The longitudinal movement of the valve body into REFILL position could cause the end of the extension 12 on the valve body to close an electric switch, now shown, for activating the motor and self-priming pump and then the switch would automatically open when the valve body H2 was moved into automatic or normal position. In FIGS. 1, 2, 3, 4, 5 and 6 we show one mechanism for moving the valve body H2 in a longitudinal direction between REFILL and AUTO (standing for the word automatic) position.

A valve body actuator L includes a rod 13 that underlies the bottom of the reservoir D, see FIG. 2, and extends beyond the front wall 14 of the reservoir with the front portion being bent at right angles to the rod to constitute a handle 15, see FIG. 1. The rod 13 is mounted in bearings, not shown, so that the rod will rotate on its longitudinal axis when the handle 15 is swung from REFILL position to AUTO position and vice versa. The rear end of the rod 13 is formed into a crank 16 whose end is slidably received in an elongated vertical slot 17 in the valve body extension 12, see FIG. 3. The valve body actuator L is shown in REFILL position in FIGS. 1 to 5 inclusive.

The operator watches the gage 1 at the front of the reservoir D and when the water level in the gage reaches a predetermined point he actuates the handle 15 and swings it to the AUTO position. This will move the valve body H2 in the direction of its length to the left from the REFILL position shown in FIGS. 2 to 5 inclusive into the AUTO position shown in FIG. 6. The AUTO position of the handle 15 is the normal position for our device to feed water automatically to the ice maker or to the ice water dispenser as needed. When the handle 15 is moved into AUTO position the conduit 8 is removed from the auxiliary water E and if the source is the five gallon jug it can be put away until again needed. The conduit 8 can be coiled and placed in an out of the way position.

The standard refrigerator shown in FIG. 1 is equipped with the ice maker B and with the ice dispenser C. The refrigerator also has the two solenoid valves F and G and with the water inlet 4 that is usually connected to the city water supply line and this requires a plumber to make such a connection. Our device has a conduit 18, see FIGS. 1, 2 and 3, that leads from the multiple valve H and connects with the water inlet 4 in the refrigerator for supplying water to both solenoid valves F and G.

Figure 6:
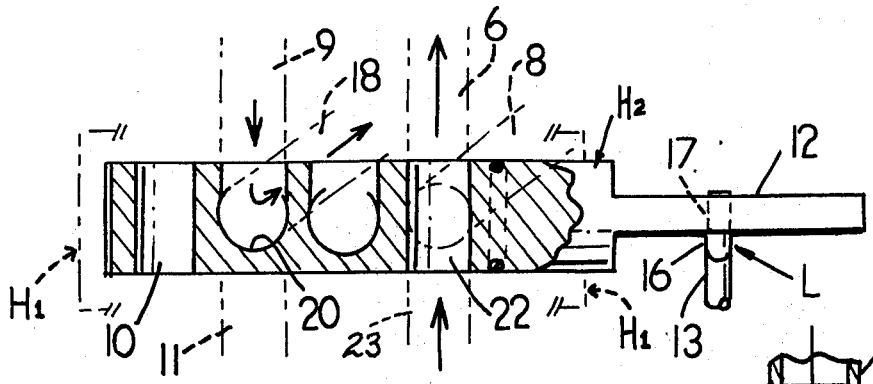
FIG. 6 is a horizontal section through the valve body and is similar to FIG. 5 excepting that the valve body is now in automatic or normal position where water will be automatically transferred from the reservoir to the automatic ice maker or to the ice water dispenser as needed.

We will now describe the apparatus for feeding water to the ice maker when needed. FIG. 6 illustrates the position of the valve body H2 when the handle 15 has been swung into AUTO position. A water pressure sensitive switch indicated generally at M in FIGS. 2 and 3, has a conduit 19 leading from it and communicating with the water outlet pipe 9 from the water pump J, see FIGS. 2, 3 and 4. The pressure sensitive switch is set to automatically close an electric circuit to the motor K when the water pressure in the pipe 9 drops below a predetermined point. The pressure sensitive switch M is set to maintain a pressure in the pipe 9 at between ten to twenty pounds.

It will be seen that in FIG. 6, when the valve body H2 has been moved into AUTO position, the pipe 9 from the water pump J, see also FIG. 4, is in communication with an L-shaped passage 20 in the valve body that in turn communicates with the conduit 18 that leads to the water inlet 4 for both the solenoid valves F and G. FIG. 1 shows a conduit 21 leading from the ice maker B to the solenoid valve F. The time fill sequence in an ice maker is eight ounces of water in a time period of about eleven seconds. In order to attain this rapid water flow, pressuring of the water is necessary because of the restrictors in the refrigerator that restrain normal city water pressure.

In normal operation of the refrigerator A, when the ice maker B in the refrigerator operates, the solenoid valve F is opened and the water pressure in the water feed line 18 drops which causes the water pressure sensitive switch M to close because the conduit 19 is in communication with the pipe 9 and with the conduit 18 through the valve body passage 20, see FIG. 6. The pump J operates and feeds water from the reservoir D to the ice maker B, as long as necessary. When the valve body H2 is in AUTO position, as shown in FIG. 6, another passage 22 in the valve body H2 places the inlet pipe 6 for the pump in communication with a stub pipe 23 that communicates with the reservoir D. Therefore, water will flow from the reservoir through the pipe 23, valve body passage 22, pipe 6, pump J, pipe 9, L-shaped passage 20 in the valve body H2, conduit 18, inlet 4, solenoid valve F, and conduit 21 to the ice maker B. The pump continues operating as long as it is necessary to supply all of the water needed for the cycle and it will then shut off when the water pressure in the line 18 reaches the high limit shut-off point which could be ten pounds and not over twenty pounds. The pump will not remain inoperative so far as the ice maker is concerned until the next ice maker cycle is reached and the low pressure in the conduit 18 causes the pressure sensitive switch to restart the motor and pump to repeat the operation we have just described.

We will now set forth the operation of our device when water is needed for the ice water dispenser. Referring again to FIG. 1, it will be seen that the standard refrigerator shown in that Figure has a conduit 23' extending from the solenoid valve G to a water cooling tank N, and a conduit 24 extends from the cooling tank to the ice water dispenser C. An electric switch 25 is positioned in back of the lever P in the water dispenser C and when this lever is manually depressed by placing a cup against it for receiving ice water from the dispenser, the switch is closed and will cause an electric current to open the solenoid valve G. The drop in water pressure in the conduits 23' and 24 caused by the water in the dispenser C flowing into the cup, not shown, will cause a similar drop in water pressure in the conduit 18 that also feeds water to the solenoid valve G. This water pressure drop will be carried to the pipe 9 through the L-shaped passage 20 in the valve body H2 and to the pressure sensitive switch M through the conduit 9 with the result that the switch M will be closed to start the motor K and the pump J. The pump will deliver water to the cooling tank N, and will cause ice water to flow from the tank and out the dispense C. As soon as the lever P is freed the switch 25 will open and the solenoid valve G will close. The water pressure in the conduit 18 will build up to a point where it will open the pressure sensitive switch M and stop the motor and pump from operating.

We have already mentioned that the installation of our device on a standard refrigerator requires no plumbing changes and can easily be installed by the buyer. The electric motor K can be connected to any house electrical outlet by the wires 26, shown in FIG. 1. The reservoir is placed on top of the refrigerator or any other convenient location near the refrigerator and the conduit 18 is connected to the water inlet 4 for the refrigerator.

The operation for filling or refilling the reservoir D has been described and so has the operation for delivering water under pressure from the reservoir D to the ice maker B, or the ice water dispenser C. These last two operations take place automatically when needed as soon as the operator swings the handle 15 to AUTO position in FIG. 1.

Our device can be used to eliminate inconvenient installations such as: an inside wall; in apartments where plumbing changes are not permitted; and places where water is not readily available for the ice maker B. Other possible uses are where colored ice cubes are to be used for a party. Colored water would be placed in the water source E and pumped into the reservoir D, as already explained. Where the water quality is poor, the water source E could contain water of the desired quality. Our device can be economical for persons who move a great deal and do not wish recurring plumbing charges. The refrigerator can be moved more readily because there is no permanent plumbing fixture. On one filling of the reservoir with water our device would function from one week to several months, this depending how often ice cubes are needed and how often ice water is drawn from the dispenser C.

We claim:

1. A refrigerator having an automatic ice maker unit with a first water conveying conduit communicating with said unit and having a solenoid valve which will automatically open when the ice maker needs water;

a. a water reservoir containing water;

b. a motor driven pump that has a water inlet communicating with the water in said reservoir, said pump having a water outlet second conduit communicating with said solenoid valve; and c. a water pressure sensitive switch in communication with said pump outlet, said switch being set to connect said motor to a source of electricity for starting the motor and pump automatically when the water pressure in said pump outlet second conduit drops below a predetermined point;

d. whereby when said automatic ice maker unit starts operating and needs additional water to make ice it will open said solenoid valve and draw on the pressurized water in said water outlet second conduit for reducing the pressure therein and cause said water pressure sensitive switch to automatically close an electric circuit to said motor for operating said pump for feeding water from said reservoir through said pump and said water outlet second conduit through said valve and said first water conveying conduit to said automatic ice maker, the water flow continuing until said automatic ice maker unit completes its cycle and shuts off and until the water pressure in said second water conveying conduit builds up to the predetermined water pressure whereupon said pressure sensitive switch will open the electric circuit to said motor and will stop both the motor and the pump.

2. The combination as set forth in claim 1: and in which a. a multiple valve controls the inlet and outlet water passages to and from said pump, the valve body normally being in a position to permit water to flow from said reservoir through said pump and into said first water conveying conduit when said automatic ice making unit starts operating;

b. an auxiliary source of water for replenishing the water in said reservoir;

c. a third conduit leading from said auxiliary water source to said multiple valve casing, said valve casing having an outlet pipe communicating with said reservoir; and d. said multiple valve having a valve body shiftable into a refill position and having passages for placing said third conduit in communication with said water inlet to said pump and for placing said pump outlet in communication with said valve casing outlet pipe;

e. whereby said motor can operate said pump for withdrawing water from said auxiliary water source through said third conduit and through said multiple valve while said valve body is in refill position, then through said pump and again through the passage in said valve body that connects the pump outlet with said casing outlet pipe for delivering the water to said reservoir.

3. A refrigerator having an automatic ice maker unit and an ice water dispensing unit with a first water conveying conduit communicating with said ice maker unit and having a first solenoid valve which will automatically open when the ice maker requires water;

a. a second water conveying conduit communicating with said ice water dispensing unit and having water in said second conduit, and a second solenoid valve which will open when a water dispensing lever is depressed for delivering ice water, the depressing of said lever closing a switch which causes an electric current to open said second solenoid valve;

b. a water reservoir containing water;

c. a motor driven pump having a water inlet communicating with the water in said reservoir, said pump having a third water outlet conduit communicating with both of said solenoid valves;

d. a water pressure sensitive switch in communication with said pump outlet, said pressure switch being set to connect said motor to a source of electricity for starting the motor and pump automatically when the water pressure in said pump outlet conduit drops below a predetermined point;

e. whereby when said automatic ice maker unit starts operating and needs additional water to make ice it will automatically open said first solenoid valve and draw on the pressurized water in said first water outlet conduit for reducing the pressure therein and cause said pressure sensitive switch to automatically close an electric circuit to said motor for operating said pump for feeding water from said reservoir through said pump and said pump water outlet conduit thence through said first solenoid valve and said first water conveying conduit to said automatic ice maker, the water flow continuing until said automatic ice maker unit completes its cycle and shuts off said first solenoid valve and until said third water conveying conduit builds up to the predetermined water pressure whereupon said pressure sensitive switch will open the electric circuit to said motor and will stop both the motor and pump; and f. whereby when said ice water dispenser lever is depressed for dispensing ice water it will close said lever actuated switch for opening said second solenoid valve and draw on the pressurized water in said third pump water outlet conduit for reducing the water pressure therein and cause said water pressure sensitive switch to automatically close an electric circuit to said motor for operating said pump for feeding water from said reservoir through said pump and its water outlet conduit, thence through said second solenoid valve and said second water conveying conduit to said ice water dispenser, the water flow continuing until said lever is released and opens the lever switch and until the water pressure in said second water conveying conduit and said third pump water outlet conduit to build up to the predetermined water pressure whereupon said water pressure sensitive switch will open the electric circuit to said motor and will stop both the motor and the pump.

* * * * *